United States Patent [19]

Paul

[11] Patent Number: 5,009,048

[45] Date of Patent: Apr. 23, 1991

[54] GLASS BLOCK WALLS USING ACRYLIC OR GLASS FILTERS

[75] Inventor: Stanley Paul, Long Island City, N.Y.

[73] Assignee: Acrymet Industries Inc., Long Island City, N.Y.

[21] Appl. No.: 394,353

[22] Filed: Aug. 15, 1989

[51] Int. Cl.[5] ..... E04G 21/18

[52] U.S. Cl. ..... 52/308; 52/306

[58] Field of Search ..... 52/306, 307, 308; 156/329; 428/49, 58

[56] References Cited

U.S. PATENT DOCUMENTS

| | | | |
|---|---|---|---|
| 1,919,643 | 7/1933 | Stewart | 52/306 |
| 2,102,149 | 12/1937 | Guthrie | 52/306 |
| 2,112,241 | 3/1938 | Hyde | 52/306 |
| 2,346,170 | 4/1944 | Kalkusch | 52/308 |
| 2,413,268 | 12/1946 | Unverferth | 52/306 |
| 3,094,446 | 6/1963 | Burdick et al. | 156/329 |
| 4,023,319 | 5/1977 | Kurata | 52/308 |
| 4,058,943 | 11/1977 | Sturgill | 52/227 |
| 4,774,793 | 10/1988 | Mayer | 52/308 |

*Primary Examiner*—David A. Scherbel
*Assistant Examiner*—Michele A. Van Patten

[57] ABSTRACT

A system of interconnected glass blocks by bonding translucent or transparent glass or plastic plates to form the joint between the abutting surfaces of each of the blocks.

7 Claims, 2 Drawing Sheets

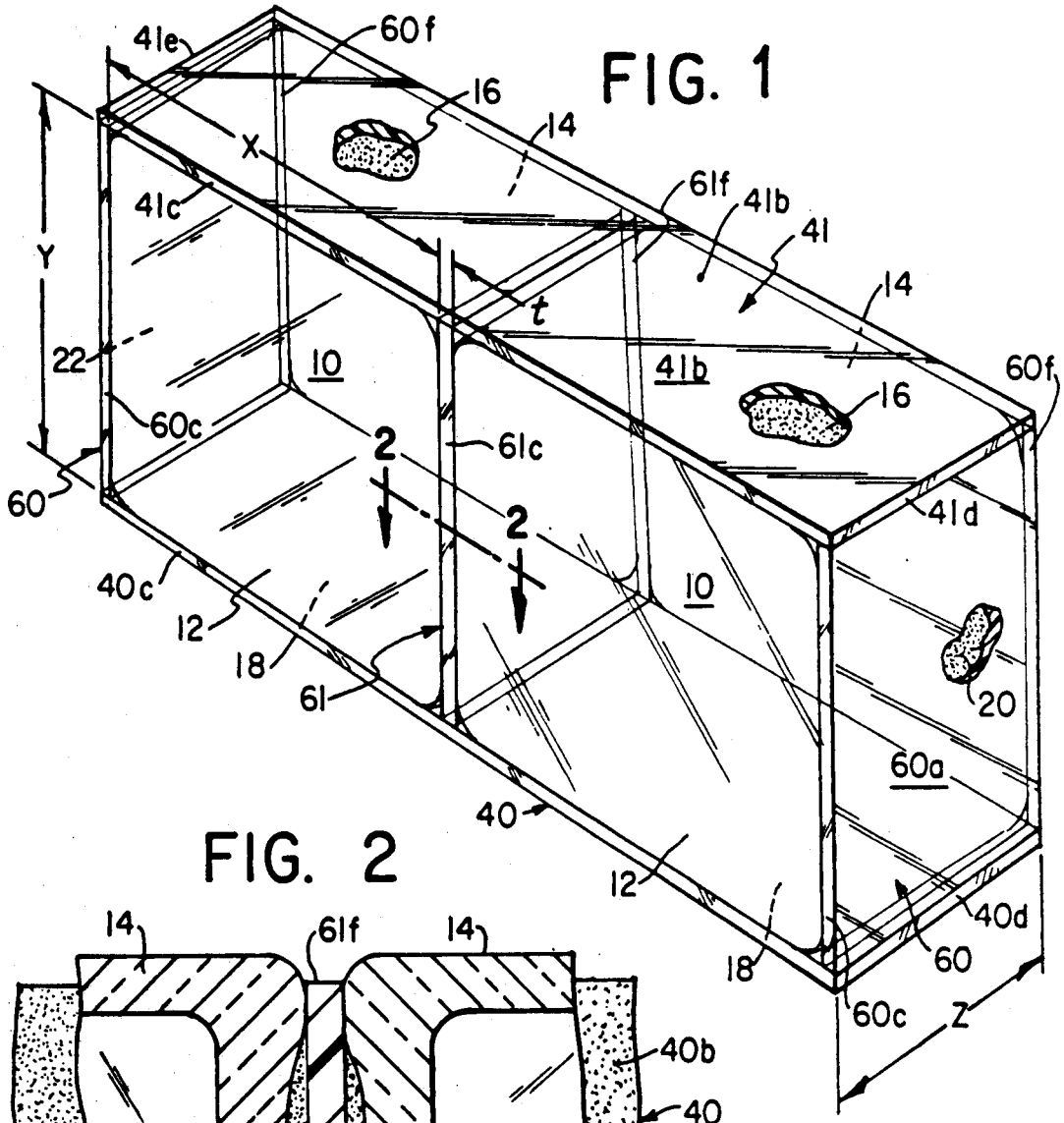
FIG. 1
FIG. 2
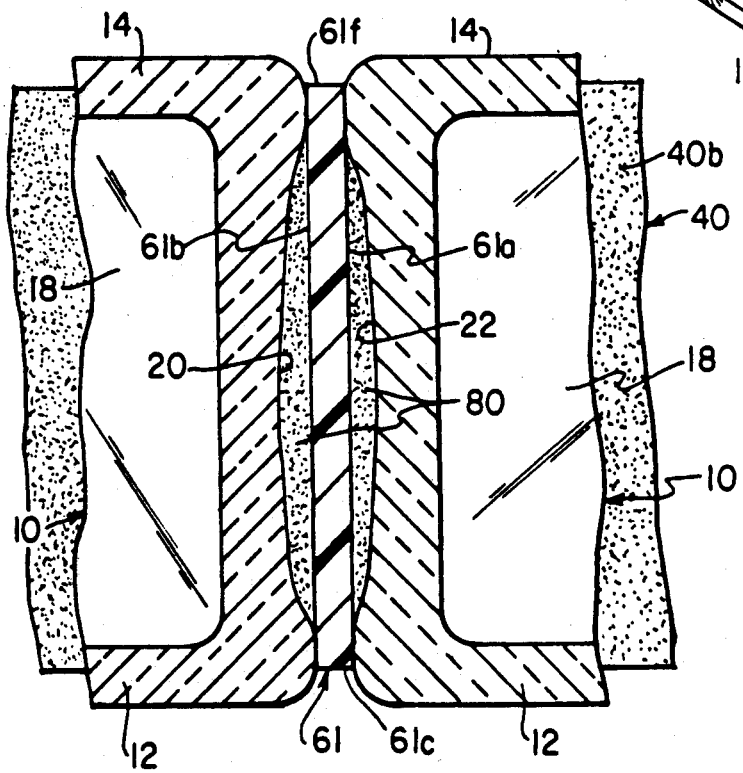

GLASS BLOCK WALLS USING ACRYLIC OR GLASS FILTERS

This invention relates to the assembly of translucent glass blocks to provide a wide variety of wall structures, and more particularly, to the assembly of glass blocks by bonding translucent or transparent glass or plastic plates to form the joint between the abutting surfaces of each of the blocks.

The use of translucent block, such as glass block, for exterior and interior applications is well known. Using glass block for various wall structures offers various design and aesthetic possibilities, as well as provides various functional characteristics and advantages over other materials which may be used for similar purposes. The selection of translucent block, such as glass block, significantly contributes to the overall aesthetic value of the wall structure or column.

Although translucent and glass blocks are available in various configurations, shapes, curvatures, symmetries and dimensions, the appearance of the abutting surfaces of the assembled blocks, particularly the appearance of the interface between abutting blocks, has not been governed by aesthetic considerations. Accordingly, the aesthetics of translucent or glass block wall structures is frequently limited by these interfaces and joints.

Abutting surfaces of adjacent blocks are frequently joined by a bonding material such as a conventional cementitious material, mortar, or adhesive material which prohibit the transmission of light to an adjacent block. Furthermore, clear adhesives or caulking is frequently not suitable for bonding one block to another because the gap or space between the abutting faces of the interfacing blocks which is to be filled by the bonding material such as a silicone compound can exceed the maximum thickness of the bonding material. Once the maximum thickness is exceeded, a secure bond cannot be obtained between adjacent blocks. This occurs most frequently with glass blocks that have concave faces.

It would be an advantage over prior art glass block walls to provide a glass wall or structure which is uninterrupted by the unslightly mortar, cement or adhesives which are used at the interfaces and abutting surfaces of adjacent blocks and which limit and interfere with the translucency of the glass wall or structure.

SUMMARY OF THE INVENTION

According to the present invention, a system of interconnected blocks are formed from a plurality of translucent blocks having side surfaces of predetermined dimensions, configuration and shape, each of which is connected on at least one side surface to a side surface of an adjacent block by a translucent filler piece having contact surfaces of substantially the same dimensions as the block side surfaces. The filler pieces abut with and mate with the side surfaces of the blocks and are affixed by the application of transparent adhesive to the contact surfaces.

BRIEF DESCRIPTION OF THE DRAWINGS

The foregoing and other features of the present invention will be more readily apparent from the following detailed description of illustrative embodiments of the invention in which:

FIG. 1 is a perspective view of two assembled glass blocks of generally regular rectangular configuration having concave surfaces which are bonded together at their abutting surfaces by clear acrylic filler pieces and clear silicone adhesive;

FIG. 2 is an enlarged sectional view of a typical joint configuration taken along line 2—2 of FIG. 1.

DESCRIPTION OF ILLUSTRATIVE EMBODIMENTS

Figure 3:
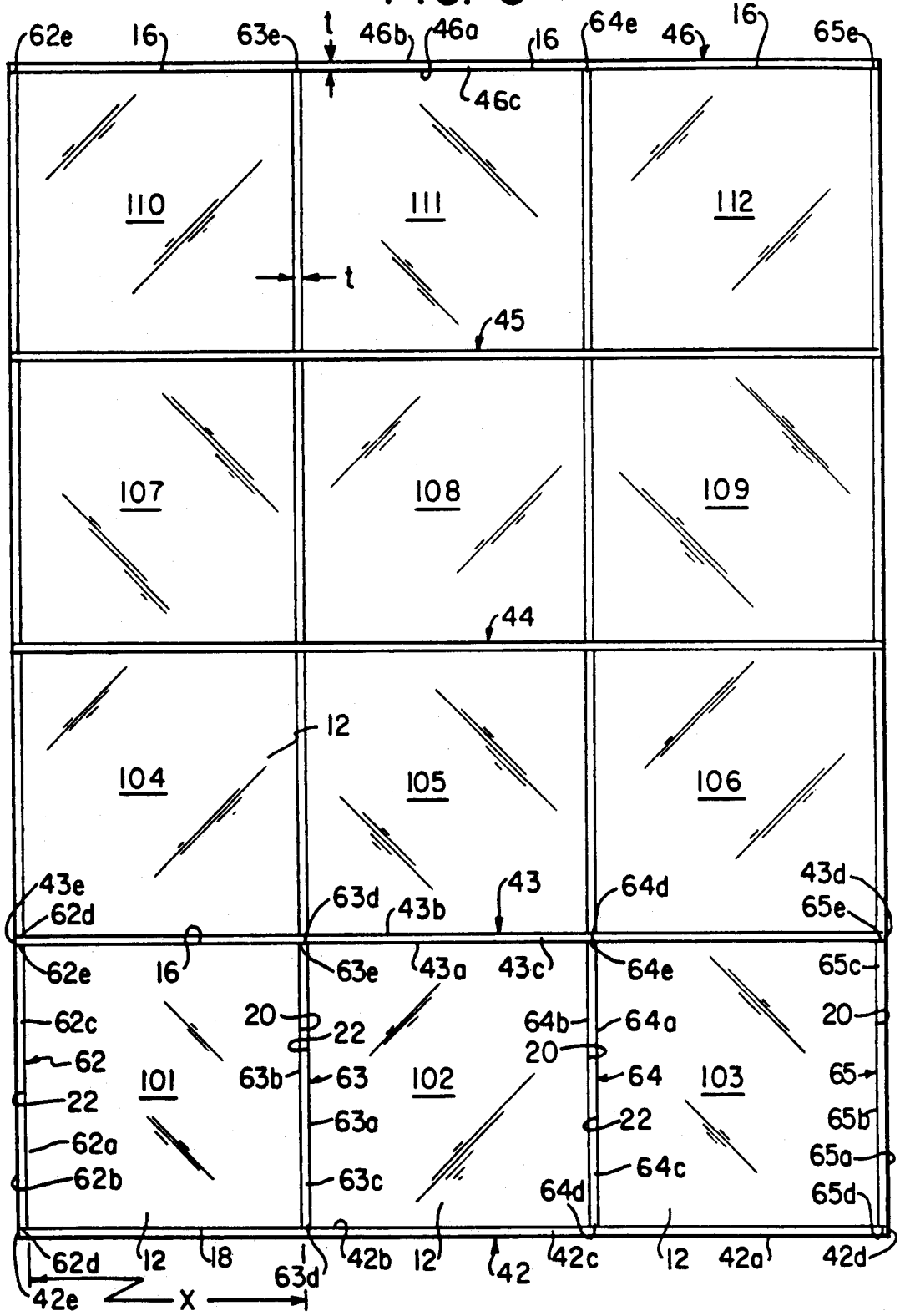
FIG. 3 is a front elevational view of a translucent wall structure composed of several glass blocks and filler pieces assembled in accordance with the present invention.

FIG. 1 shows two typical glass blocks 10 each having front side face 12, back side face 14, upper side face 16, lower side face 18 and end side faces 20 and 22. Faces 16, 18, 20 and 22 have substantially concave surfaces. Front and back side faces 12 and 14 are shown as smooth although they may also be concave. The length, height and thickness of blocks 10 are indicated by the letters x, y, and z as shown in FIG. 1. Useful in the practice of this invention are glass blocks which are available from a number of commercial sources. (e.g. Pittsburgh Corning Corporation, Pittsburgh Pa., and Westerwald A.G., West Germany which manufactures glass blocks under the tradename of Solaris). Each of the two blocks 10 is positioned between translucent or transparent horizontal interfacing filler pieces 40 and 41. Horizontal translucent/transparent interfacing filler piece 41 is affixed to each upper face 16 of blocks 10 by a clear adhesive 80 (FIG. 2). Useful in the practice of the invention are clear adhesives manufactured by General Electric Co., Silicone Products Division, Waterford, N.Y. under the tradename Construction 1200 Silicone Sealant, and by Dow Corning Corp., Midland, Mich. and designated as silicone building and glazing sealant 999-A. Translucent/transparent vertical interfacing piece 61 is similarly affixed by clear adhesive 80 to the end side faces 20 and 22 of blocks 10 which abut one another. Two translucent/transparent vertical interfacing pieces 60 are identical to vertical piece 61 and are affixed to the nonabutting end side faces 20 and 22 by adhesive. With the exception of front end face 12 and back end face 14, each face of each block is affixed to an interfacing filler piece.

Translucent/transparent vertical and horizontal interfacing filler pieces 40, 41, 60 and 61 are prefabricated cast acrylic sheets or plate glass sheets of predetermined thickness depending upon the contour of the block faces and the thickness "t" of the joint required. Typical thicknesses are ¼" and ⅜". The other dimensions of vertical filler pieces 60 and 61 will depend upon the particular dimensions of the blocks selected. The length of horizontal filler pieces 40 and 41 will depend upon the length of the wall structure whereas its width depends solely upon the thickness of the block. Thus, if one desired to erect a wall approximately four feet long from blocks 8" long×6" high×4" thick, four foot horizontal filler pieces 4" wide and vertical filler pieces 6"×4" would be used.

Examples of acrylic sheets which are useful in the practice of this invention are manufactured by Rohm and Haas Co., Philadelphia, Pa. under the tradename Plexiglass, by Polycast Technology Corp., Stamford, Conn. under the tradename Polycast, and by American Cyanamid Co., Wayne, N.j. under the tradename Acrylite. An example of plate glass useful in the practice of this invention is manufactured by PPG Industries, Pittsburgh, PA.

Horizontal pieces 40 and 41 can be fabricated and supplied in any convenient length such as 2', 4', 6', 8' etc Vertical filler pieces on the other hand are one common size depending upon the dimensions of the individual block. After fabrication of the horizontal and vertical filler pieces, each exposed edge e.g. 40*c*, 41*c*, 60*c* and 61*c* is polished. After assembly, each polished exposed edge of the vertical and horizontal filler pieces is perfectly clear and blends with the glass blocks and clear adhesive. In addition to the elimination of unsightly cement, mortar, and/or caulking joints, a very aesthetically pleasing integrated translucent structure is formed.

FIG. 2 is an enlarged sectional view taken along the line 2—2 of FIG. 1. Clear adhesive 80 is shown on end side faces 20 and 22 of blocks 10 as well as on surfaces 61*a* and 61*b* of filler piece 61. The concave shape of faces 20 and 22 of blocks 10 are also shown in FIG. 2.

FIG. 3 is an elevational side view of a translucent/-transparent wall structure composed of four rows and three columns of glass blocks. Each of the blocks 101–112 has the same dimensions, configurations and contours as blocks 10 shown in FIGS. 1 and 2. Thus, side faces 12–22 of blocks 101–112 are identically to the corresponding side faces of blocks 10.

Horizontal filler piece 42 which forms the bottom of the wall structure is installed and adhesive 80 applied to glass block contact surface 42*b*. Adhesive is also applied to vertical filler piece surface 62*a*, and to filler piece edge 62*d* which is to be affixed to filler piece surface 42*b*. Block 101 is then installed by placing block lower side face 18 and block end side face 22 in contact with surfaces 42*b* and 62*a*, respectively as shown in FIG. 3. Adhesive 80 is next applied to surfaces 63*a*, 63*b* and edge 63*d* of vertical filler piece 63 to secure it to block 101 and to horizontal filler piece 42 as well as prepare for the installation of block 102. Edge 63*d* of vertical filler piece 63 is mounted onto horizontal filler piece 42 so that surface 63*b* contacts side face 20 of block 101 and is affixed thereto by the adhesive. Block 102 is affixed to horizontal piece 42 (upon which adhesive had been previously applied) in the same manner as block 101. Vertical piece 64 is affixed to surface 42*b* of horizontal piece 42 and to surface 20 of block 102 in the same way, as discussed above, that vertical piece 63 is affixed to surfaces 42*b* and 62*a*. To complete the first row, adhesive is applied to edge 65*d* and surface 65*b* of vertical piece 65 which is then placed in contact with horizontal piece 42 and side face 20, respectively, of block 103.

The next and each succeeding row of blocks (104–106, 107–109, 110–112) are assembled in the same manner. Each block in the second and third row is affixed by adhesive to a lower and an upper horizontal filler piece as well as to vertical filler pieces. The block wall shown in FIG. 3 is completed by applying adhesive to surface 46*a* of horizontal piece 46 and placing it in contact with edges 62*e*, 63*e*, 64*e*, 65*e* of the vertical filler pieces and upper surface 16 of each of blocks 110–112.

The completed wall structure shown in FIG. 3 is aesthetically pleasing in that all joints, abutting surfaces, as well as interfaces, are translucent and/or transparent. The aesthetics of the completed structure is further enhanced due to the polished edges of all exposed vertical and horizontal transparent/translucent interfacing filler pieces (i.e. 62*c*, 63*c*, 64*c*, 65*c*, 42*c*, 43*c*, 44*c*, 45*c*, 46*c*). If any other surface of the glass wall shown in FIG. 3 is intended to be visible to an observer (e.g. top surface 46*b* of the top horizontal piece 46), then it can be polished prior to installation.

Other configurations of translucent or glass block wall structures are possible by utilizing individual blocks having geometries other than regular rectangular solids with flat or concave faces. Depending upon the particular configuration as well as the composition of the glass blocks to be utilized, varying degrees of light transmission through the translucent blocks and the vertical and horizontal filler pieces are possible. Furthermore, when translucent or transparent building blocks having at least one internal reflecting/refracting surface, other pleasing visual effects can be obtained.

While the present invention has been particularly shown and described with reference to a preferred embodiment thereof, it will be understood by those skilled in the art that various changes in form and details may be made therein without departing from the spirit and scope of the invention.

I claim:

1. An array of translucent blocks, comprising:

a plurality of translucent blocks arranged in horizontal rows and vertical columns;

horizontal and vertical transparent plastic filler pieces between adjacent blocks, said plastic filler pieces extending at least across the entire length or height of the adjacent blocks, the width of said filler pieces being substantially equal to the width of said translucent blocks, each said plastic filler piece including at least one edge that is visible as part of said array, the edges of said plastic filler pieces that are visible being sufficiently smooth so as to be transparent, whereby the material between said blocks that is visible appears to be transparent; and adhesive means for securing each filler piece to the contiguous surfaces of adjacent one of said translucent blocks.

2. An array of translucent blocks according to claim 1, wherein the filler pieces are cut to their desired width and the edges of said filler pieces which are visible when the array is viewed are polished to transparency.

3. An array of translucent blocks according to claim 1, wherein said adhesive means comprises a light transmitting adhesive.

4. An array of translucent blocks according to claim 3, wherein said translucent blocks comprise glass blocks.

5. An array of transparent blocks according to claim 1, wherein said filler pieces comprise acrylic plates.

6. An array of translucent blocks according to claim 5, wherein said adhesive means comprises a transparent silicone adhesive.

7. In combination, a plurality of horizontally and vertically stacked glass blocks, horizontally and vertically arrayed colorless, transparent acrylic plates positioned between said glass blocks and extending across the entire length or height of the adjacent blocks, the depth of said acrylic plates being substantially the same as the depth of said glass blocks, with the edge surface of each of said acrylic plates which is visible between said glass blocks being polished to provide a clear transparent surface, and a transparent adhesive for securing the surfaces of said acrylic plates to the contiguous surfaces of adjacent glass blocks.

* * * * *